US009810386B2

(12) United States Patent
Hickenbottom

(10) Patent No.: US 9,810,386 B2
(45) Date of Patent: Nov. 7, 2017

(54) LIGHTING APPARATUS

(71) Applicant: Robert Hickenbottom, Escondido, CA (US)

(72) Inventor: Robert Hickenbottom, Escondido, CA (US)

( * ) Notice: Subject to any disclaimer, the term of this patent is extended or adjusted under 35 U.S.C. 154(b) by 176 days.

(21) Appl. No.: 14/874,447

(22) Filed: Oct. 4, 2015

(65) Prior Publication Data

US 2017/0097127 A1 Apr. 6, 2017

(51) Int. Cl.

| | |
|---|---|
| ***F21L 14/00*** | (2006.01) |
| ***F21V 23/06*** | (2006.01) |
| ***F21V 21/06*** | (2006.01) |
| ***F21S 2/00*** | (2016.01) |
| ***F21V 21/08*** | (2006.01) |
| *F21W 131/10* | (2006.01) |
| *F21Y 103/00* | (2016.01) |
| *F21Y 113/00* | (2016.01) |
| *F21Y 115/10* | (2016.01) |

(52) U.S. Cl.

CPC ..... *F21L 14/00* (2013.01); *F21S 2/00* (2013.01); *F21V 21/06* (2013.01); *F21V 21/08* (2013.01); *F21V 23/06* (2013.01); *F21W 2131/1005* (2013.01); *F21Y 2103/00* (2013.01); *F21Y 2113/00* (2013.01); *F21Y 2115/10* (2016.08)

(58) Field of Classification Search

CPC ... F21L 14/00; F21W 2131/402; F21V 21/06; F21V 23/06

See application file for complete search history.

(56) References Cited

U.S. PATENT DOCUMENTS

| | | | |
|---|---|---|---|
| 5,590,956 | A | 1/1997 | Messana |
| 8,485,699 | B2 | 7/2013 | Reda, Jr. |

OTHER PUBLICATIONS

Bosch FL11 from website—ToolGuyd.com/bosch-12v-led-worklight-vacuum, Sep. 8, 2014.*
Amazon.com, Defender E712600.
Amazon.com, Designers Edge L14SLED.

* cited by examiner

*Primary Examiner* — David V Bruce
(74) *Attorney, Agent, or Firm* — Themis Law

(57) ABSTRACT

A lighting apparatus includes a base dimensioned to be portable by an adult and one or more lamps extending upwardly from the base. A plurality of openings are defined in the base, in order to enable an operator to couple the base to a surface or to a scaffolding tube. The lamps have a longitudinal portion that prevents passage of light. In one embodiments, the lighting fixture includes two elongated lamps that are joined by a bridge at their upper ends.

15 Claims, 9 Drawing Sheets

LIGHTING APPARATUS

FIELD OF THE INVENTION

The present invention relates to a lighting apparatus. More particularly, the present invention relates to a lighting fixture that is portable, can be easily affixed to a surface or a scaffolding, and that can project light tangentially on a surface.

BACKGROUND OF THE INVENTION

Lighting fixtures are used in the construction industry not only to provide visibility, but also as tools to inspect the quality of a surface finish, such as the finish of a vertical wall or a ceiling.

Lighting fixtures that are designed for use in the construction industry and that are known in the prior art may be of different kinds One common kind is composed of an upright fluorescent tube hat projects light with a 360° angle and that is supported by a tripod, such as the Defender E712600 light marketed by Professional Fluorescent Lighting, LLC.

A second kind is composed of a pair of halogen lights that project light forward and that are also supported by a tripod, such as the Designers Edge L14SLED light marketed by Designers Edge.

Another kind includes upright fluorescent lamps supported by a self-righting body, such as the lighting fixtures disclosed in U.S. Pat. No. 8,485,699 to Reda and U.S. Pat. No. 5,590,956 to Messana et al.

These types of lighting fixtures, however, are all bulky and heavy, which causes their use to be cumbersome on construction sites.

When used as inspection tools, the lighting fixtures in the prior art highlight surface defects poorly. The light projected by those lighting fixtures is either spread around 360°, without focusing on the surface to be inspected, or, if projected in a specific direction like in the Designers Edge light fixture, the bulky construction of the fixture causes the lamps to be suited only to project light essentially perpendicularly to the wall rather than tangentially, as it would be desirable to highlight imperfections.

In addition, any metal grids disposed in front of the lamps create shadows that project on the surface being illuminated, making inspection more cumbersome and sometimes hiding surface defects.

BRIEF SUMMARY OF THE INVENTION

The present invention overcomes the drawbacks of lighting fixtures in the prior art by providing a lighting apparatus that is compact and portable, and that enables an operator to project light tangentially along a surface to be inspected and rapidly identify any imperfections.

A lighting apparatus according to the invention also reduces power consumption and light emission temperature compared to lighting fixtures in the prior art.

In a preferred embodiment, a lighting apparatus according to the invention includes a base dimensioned to be portable by an adult, and one or more lamps that extend upwardly from the base. A plurality of openings is defined in the base, in order to enable an operator to couple the base to a surface or to a scaffolding tube. Each of the lamps has a longitudinal portion that prevents the passage of light, causing the light to be projected only from the clear portion of the lamps.

In one embodiment, the openings in the base are spaced evenly around the lamps, and at least some of the openings are configured to receive a fastener such as a nail or a screw that affixes the base to a surface. Additional larger openings may also be provided in the base, which are dimensioned to receive the end of tube of a scaffolding.

The base of the lighting apparatus may also include a plurality of foot members that extend from a lower surface of the base, and at least one of the fastener-sized openings may be positioned to extend longitudinally through one of the foot members.

The lamps may tubular LED lamps, such to reduce heat emission and power consumption. In one embodiment, the longitudinal portions of the lamps preventing the passage of light may be strips of an aluminum coating provided on the tubular LED lamps and may also be reflective.

In one embodiment, the lighting apparatus may also include clear sleeves that are provided over the tubular LED lamps, in order to protect the lamps without affecting light emission or weight significantly.

In the preferred embodiment, there are two lamps of elongated in shape that are joined by a bridge at their upper ends. The bridge may have a notch defined on its lower surface to enable suspending the lighting apparatus from a protruding member such as a nail or screw, and may further have an eyelet on its upper surface.

A lighting apparatus according to the invention may also include one or more coupling ties coupled to the eyelet of the bridge, which enable an operator to couple the lighting apparatus to an outer member. The one or more coupling ties are preferably gear ties, which can be shaped as hooks that support the weight of the lighting apparatus.

A contractor-grade electric plug and a contractor-grade electric socket may also be provided in, or extend from, the base. In one embodiment, the contractor-grade electric plug and the contractor-grade electric socket extend upwardly from the base and are coupled to the base by a cable surrounded by a coil to increase the rigidity of the cable while maintaining flexibility.

In different embodiments, the plug and socket may be used to feed power to or receive power from the lighting fixture, and may enable a connection among a plurality of light in a daisy-chain arrangement.

BRIEF DESCRIPTION OF THE SEVERAL VIEWS OF THE DRAWINGS

The drawings constitute a part of this specification and include exemplary embodiments of the invention, which may be embodied in various forms. It is to be understood that in some instances various aspects of the invention may be shown exaggerated or enlarged to facilitate an understanding of the invention.

DETAILED DESCRIPTION OF EMBODIMENTS OF THE INVENTION

Detailed descriptions of embodiments of the invention are provided herein. It is to be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

Figure 1:
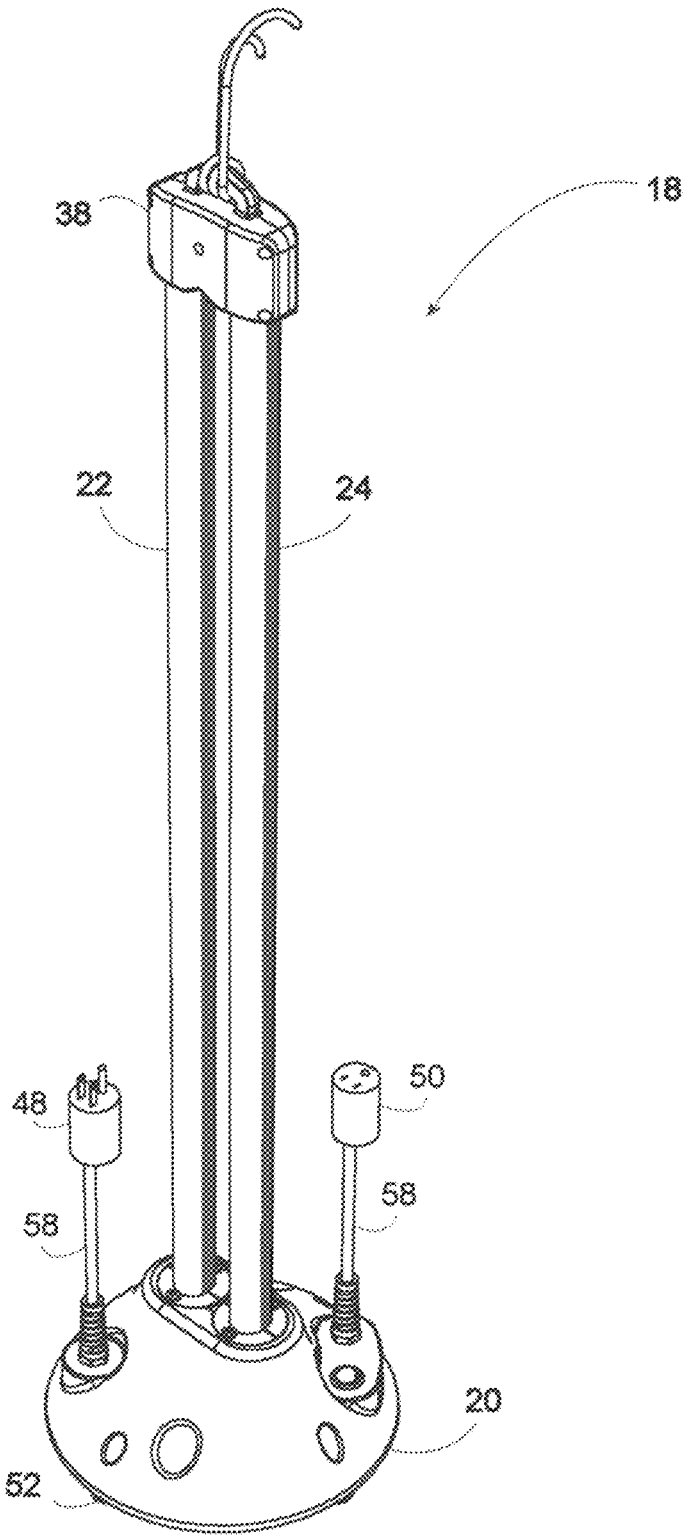
FIG. 1 illustrates a first perspective view of a lighting apparatus according to the invention.

FIG. 1 shows a perspective view of a lighting apparatus 18 constructed according to the principles of the present invention. The basic constituent elements of the embodiment depicted in FIG. 1 are a base 20 and two lamps 22 and 24 extending upwardly from base 20. FIGS. 3-6 depict front, back, left and right elevational views of the same embodiment.

Base 20 is dimensioned to be carried by an adult person, for example, a construction operator working on a construction site. Therefore, base 20 has a weight such that it can be carried by the construction operator with one or both hands and is shaped to be easily positioned within a relatively small space. In one embodiment, base 20 has a weight of 1-3 kg (2-6 lb) and a round outer perimeter of 20-40 cm (8-32 in).

Moreover, base 20 has a reduced height, such that light from lamps 22 and 24 is projected tangentially on the surface where lighting apparatus is positioned. For example, base 20 may have a height of a 12.5 cm (5 in) or less, preferably 7.5-10 cm (3-4 in).

Figure 7:
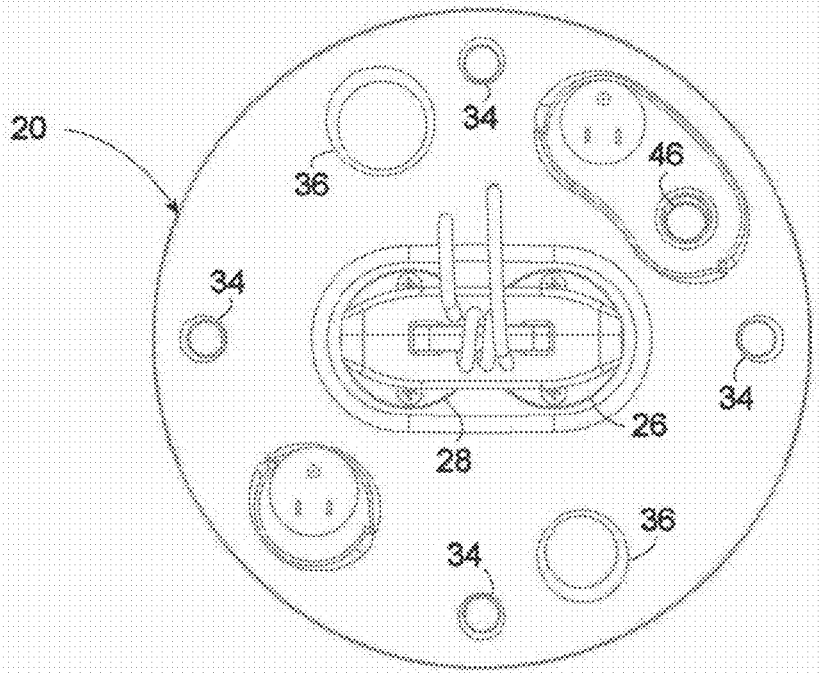
FIG. 7 illustrates a top view of the lighting apparatus of FIG. 1.

As shown more clearly in the top view of FIG. 7, base 20 has two sockets 26 and 28 configured to receive respectively lamps 22 and 24, which, after insertion into sockets 26 and 28, become mechanically and electrically coupled to base 20. In one embodiment, lamps 22 and 24 are connected to base 20 with bayonet connections.

Figure 2:
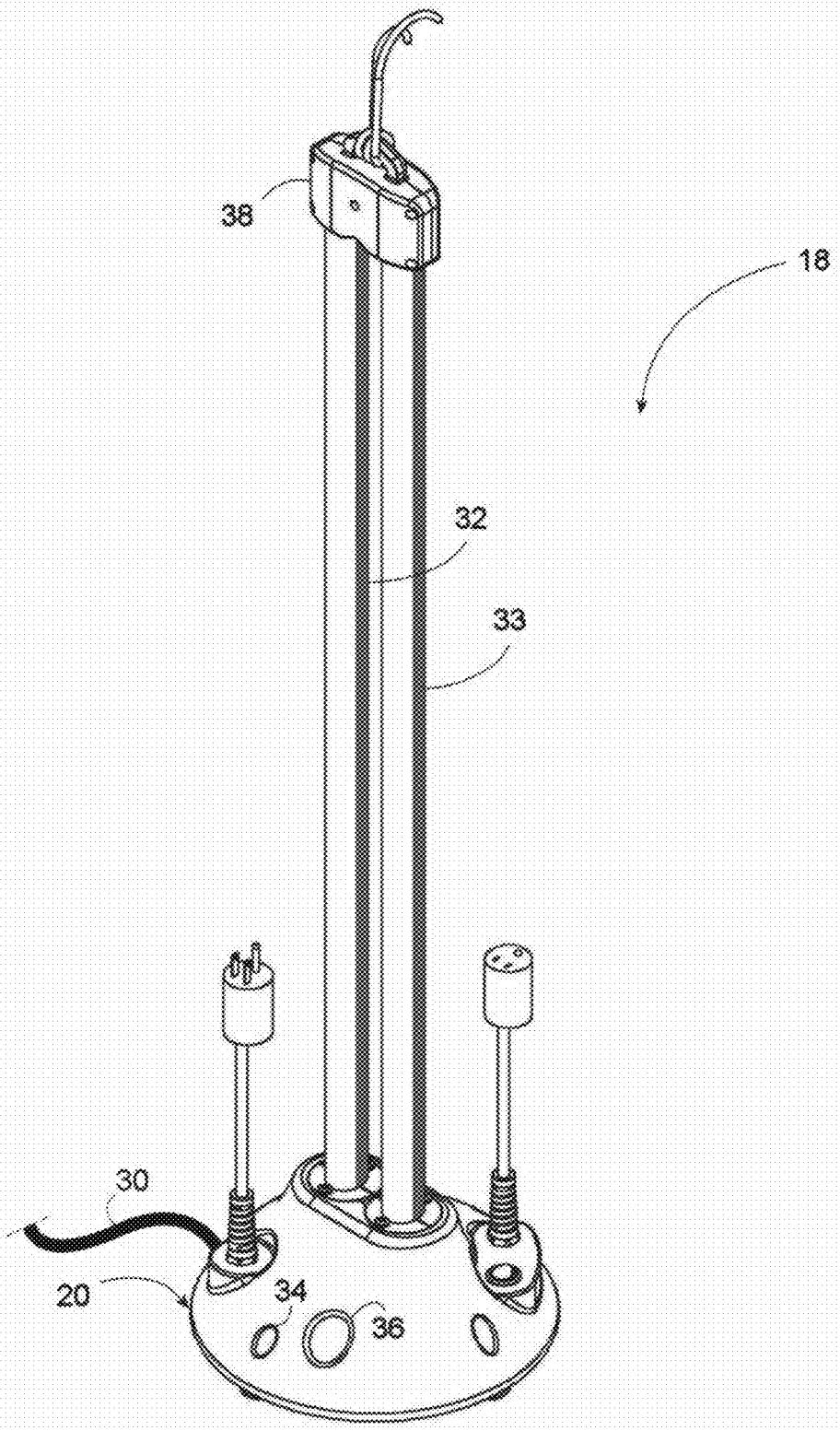
FIG. 2 illustrates a second perspective view of the lighting apparatus of FIG. 1.
Figure 3:
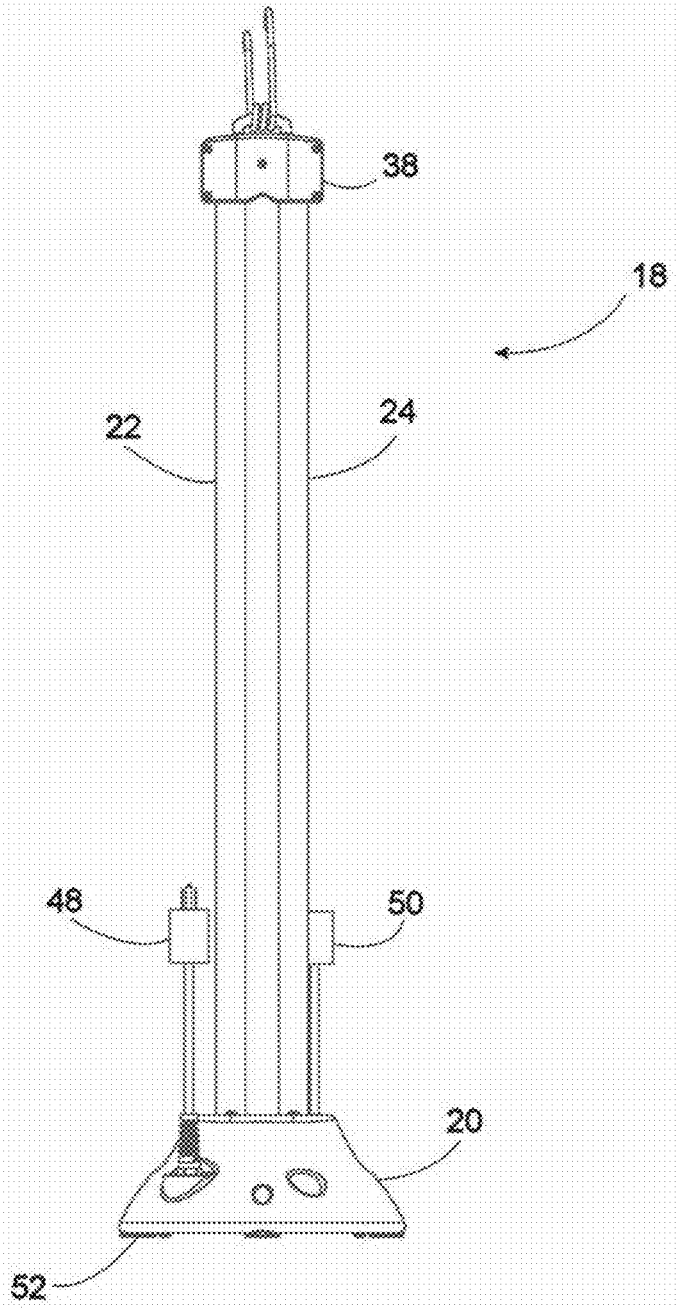
FIG. 3 illustrates a front view of the lighting apparatus of FIG. 1.
Figure 4:
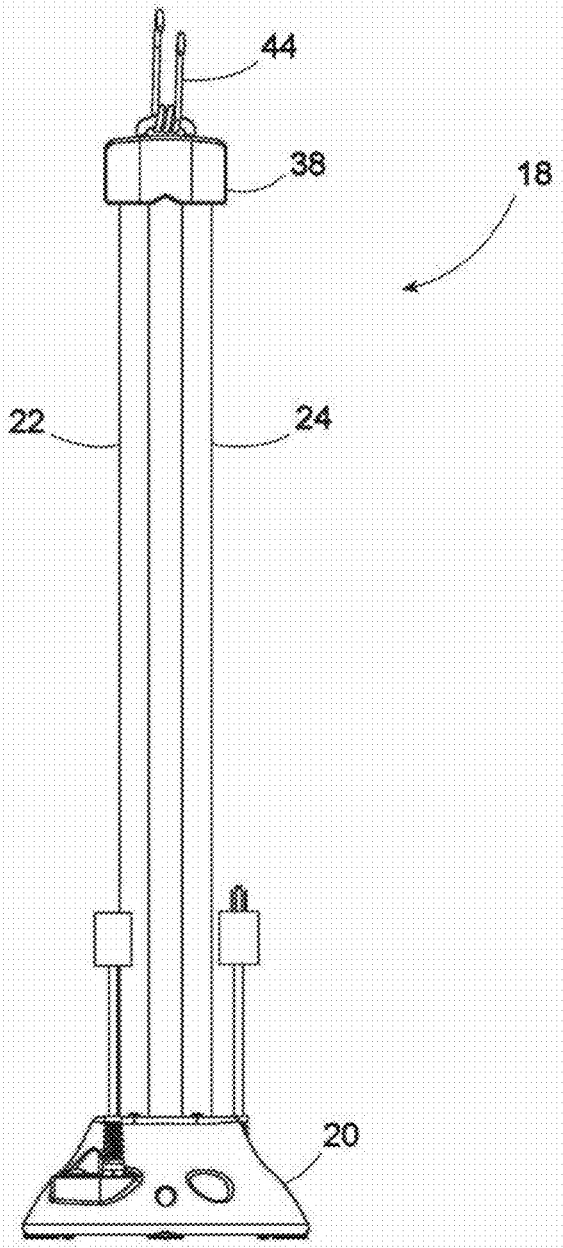
FIG. 4 illustrates a rear view of the lighting apparatus of FIG. 1.
Figure 5:
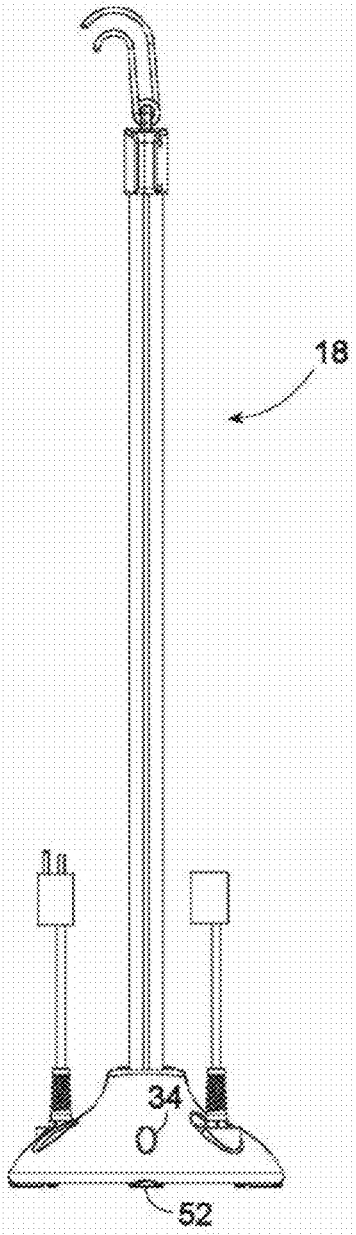
FIG. 5 illustrates a left view of the lighting apparatus of FIG. 1.
Figure 6:
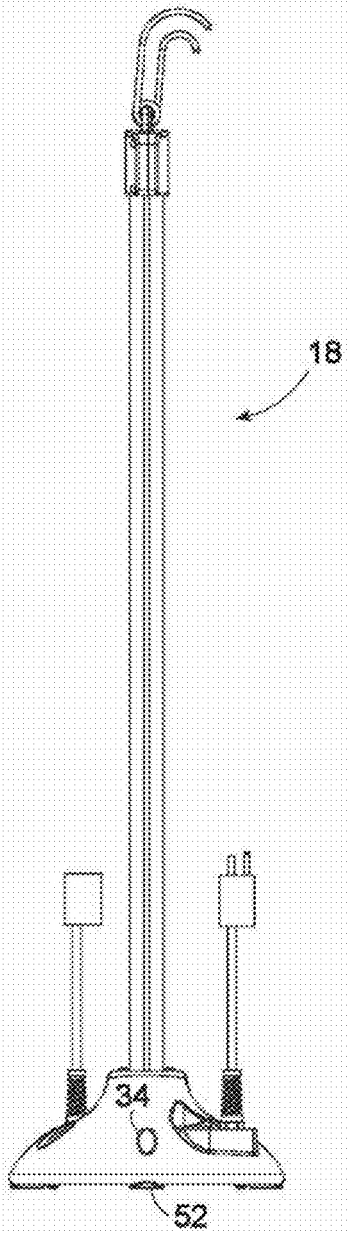
FIG. 6 illustrates a right view of the lighting apparatus of FIG. 1.

A cord 30, shown in the second perspective view depicted in FIG. 2, provides an electric connection between base 20 and an electric outlet. In a different embodiment, electrical power is provided to lighting apparatus 18 through a plug 48 or a socket 50 on base 20 or extending from base, which can be connected to cord carrying electric power.

Lamps 22 and 24 are preferably LED tubular lights. The use of LED lights provides for a lower power consumption and a lower heat emission, as well as for a longer lamp life. Among other things, a lamp according to the invention uses about 18 W of energy, compared to about 500 W used by lamps prevalent in the construction industry today. In different embodiments, lamps of 30, 60, 90 or 120 cm (1, 2, 3 or 4 ft) length are preferably employed, although lights of different lengths may be also employed.

Lamps 22 and 24 are preferably made of a translucent (e.g. milky-colored) material rather than a clear material. While a clear material projects a greater amount of light on a surface, it also projects shadows, which is detrimental when lighting apparatus is used as an inspection tool to detect surface imperfections. One the contrary, a translucent material projects light that is more uniform and shadow-free. Moreover, using lamps 22 and 24 made of a translucent material reduces eye fatigue for the operator.

As also shown in FIG. 2, lamps 22 and 24 include longitudinal strips 32 and 33 that prevent the passage of light. Strips 32 and 33 are arranged to face in the same direction, such that, when lamps 22 and 24 are in use, light is projected in one direction but not in the opposite direction. In one embodiment, strips 32 and 34 are formed by an aluminum-based coating that is deposited on the inner walls of lamps 22 and 24 and that is preferably reflective. Different embodiments of the invention, however, may include strips 32 and 33 that are formed differently, for example, by attaching a strip of non-transparent tape on a wall of lamps 22 and 24.

As shown more clearly in the top view illustrated in FIG. 7, base 20 has a plurality of small openings 32 defined therein, which may be shaped as through-holes. In the illustrated embodiment, there are four small openings 32 that are dimensioned to receive a fastener such as a nail or screw, thereby enabling a construction operator to affix lighting apparatus 18 to a surface. In a construction project, the construction operator may affix lighting apparatus 18 to the wall of a room, or to the ceiling, or to a board that can be moved around. In particular, FIG. 12 illustrates a lighting apparatus 18 according to the invention affixed to a vertical wall and projecting light upward, evidencing an imperfection 56 in the wall to the construction operator.

The use of lighting apparatus 18 as an inspection device is made possible by the portability of lighting apparatus 18, due to its shape, dimensions, and weight. Experiments by the inventor have demonstrated that a lighting apparatus according to the invention, used in a dark room, reveals wall defects (for example, defects in the uniformity of sheetrock patches) that would not otherwise be noticeable with a bare eye or with lamps according to the prior art.

Figure 12:
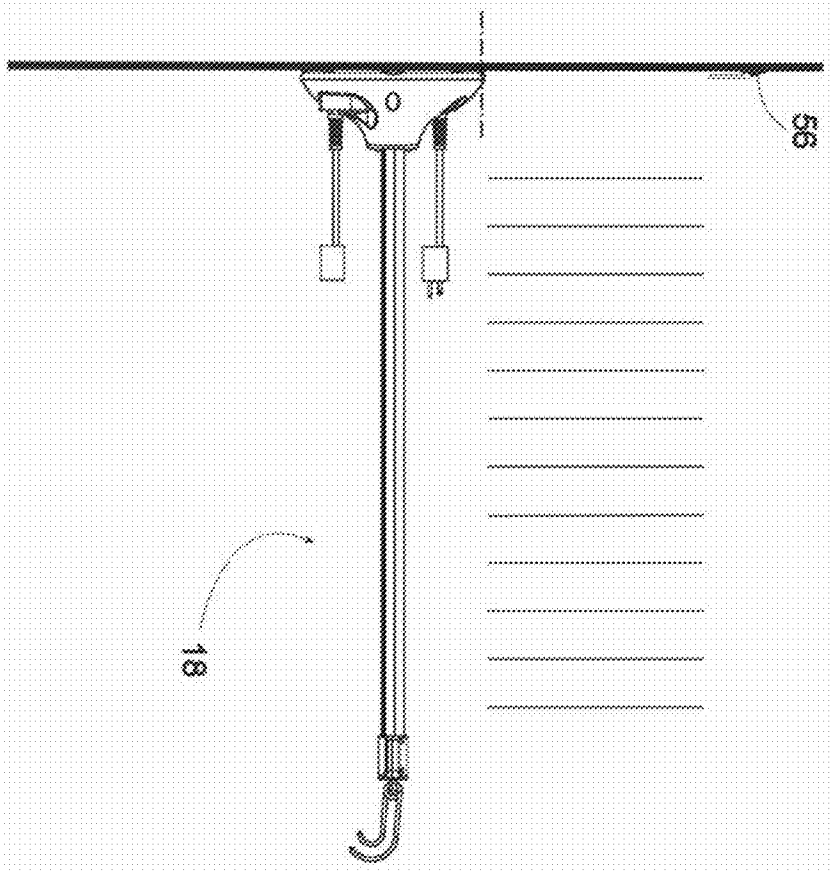
FIG. 12 illustrated a method of use of the lighting apparatus of FIG. 1.

Moreover, when base 20 is affixed to a wall with a fastener as shown in FIG. 12, the construction operator can rotate lighting apparatus 18 about the fastener, projecting light in different directions as desired and reducing the time for inspection of different parts of the same wall.

In the embodiment illustrated in FIG. 7, there are four small, fastener-sized openings that are equally spaced around lamps 22 and 24. In different embodiments of the invention, there may be a different number of fastener-sized openings, and the fastener-sized openings may be spaced at unequal distances.

Base 20 may also have one or more large openings 36 defined therein, which are sized to receive the end of a tube forming the structure of a scaffolding. Large openings 36 enable an operator to hang lighting apparatus 18 from the edge of a scaffolding by inserting the end of a scaffolding tube into one of large openings 36, further improving the portability and usefulness of lighting apparatus 18.

Even in this case, any number of large openings 36 may be defined in base 20, and large openings 36 may be distributed in no particular order, for example, may be spaced evenly or unevenly from one another. In one embodiment, large openings 36 are of different diameters, for example, a first large opening may have a diameter of 27 mm (1 1/16 in) to receive a 25 mm (1 in) scaffolding tube, and a second large opening may have a diameter of 33 mm (1 5/8 in) to receive a 25 mm (1 in) scaffolding tube.

Base 20 may further include a switch 46 (shown for example, in FIGS. 7 and 9) that turns lamps 22 and 24 on and off. Switch 46 is preferably a push-button switch that can be easily actuated with a finger or foot of the operator according to the position of lighting apparatus 18.

Figure 10:
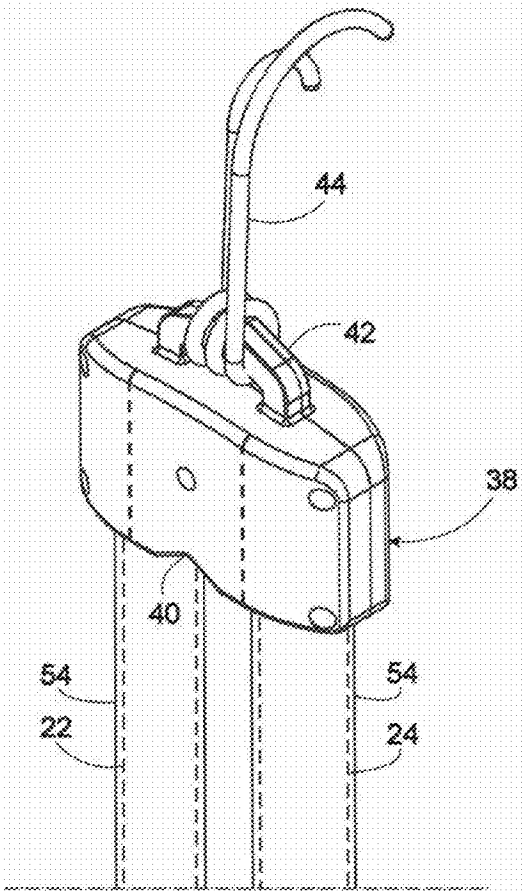
FIG. 10 illustrates a detail view of the top portion of the lighting apparatus of FIG. 1.

Turning again to FIGS. 1 and 2, and further referring to FIG. 10, the upper ends of lamps 22 and 24, opposite to base 20, may be joined by a bridge 38. In the illustrated embodiment, bridge 38 is a plastic member having two openings on its lower surface that are dimensioned to receive and hold firmly the upper ends of lamps 22 and 24, such that an operator can carry lighting apparatus 18 by holding bridge 38. For example, the upper ends of lamps 22 and 24 may be held in place by interference fit, or by a bayonet connection, or bridge 38 may be formed by two halves that receive the upper ends of lamps 22 and 24 between them and hold them snugly when the two halves are joined, for example with fasteners or by snap engagement.

In the illustrated embodiment, bridge 38 is a plastic piece having an essentially rectangular shape. In different embodiments, the front and rear walls of bridge 38 are may be outwardly convex, or may be defined by three flat surfaces that are laterally adjoined, or be formed by two lateral convex surfaces with a concave surface therebetween as in the embodiment depicted in FIG. 10. A person of skill in the art will appreciate that bridge 38 may have different shapes and be made of different materials, its only purpose being to join and holds firmly the upper ends of lamps 22 and 24.

As also shown in FIG. 10, bridge 38 may have a notch 40 defined in its lower surface, in order to enable an operator to hang lighting apparatus 18 to a nail or screw disposed within notch 40. Bridge 38 may further include an eyelet 42 that extends from it upper surface, in order to enable an operator to hang lighting apparatus 18 on a nail disposed within eyelet 42.

Further, one or more coupling ties 44 may be provided that are coupled to, and extend from eyelet 42. In one embodiment, coupling ties 44 are gear ties. The low weight of lighting apparatus 18 makes it possible to suspend lighting apparatus 18 using only gear ties 44. When bent, gear ties 44 enable an operator to form a hook with which to hang lighting apparatus 18 from a protruding member or a railing.

Figure 9:
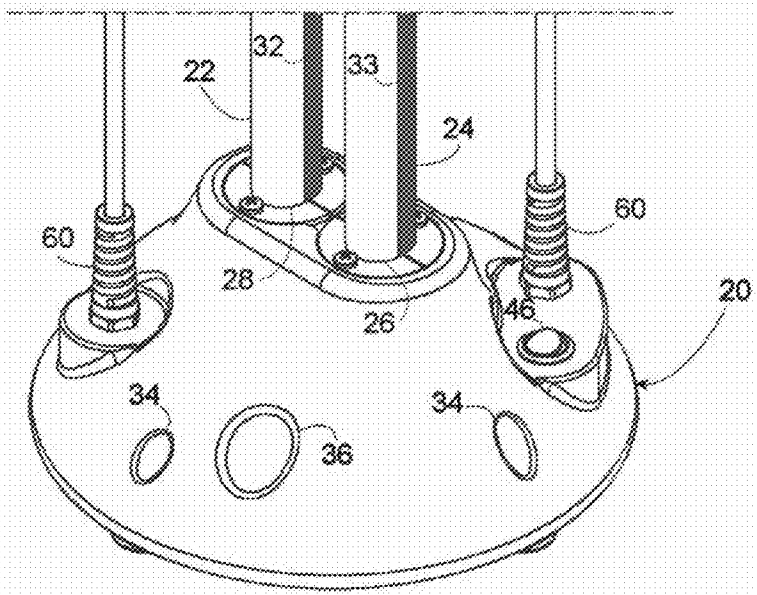
FIG. 9 illustrates a detail view of the bottom portion of the lighting apparatus of FIG. 1.
Figure 11:
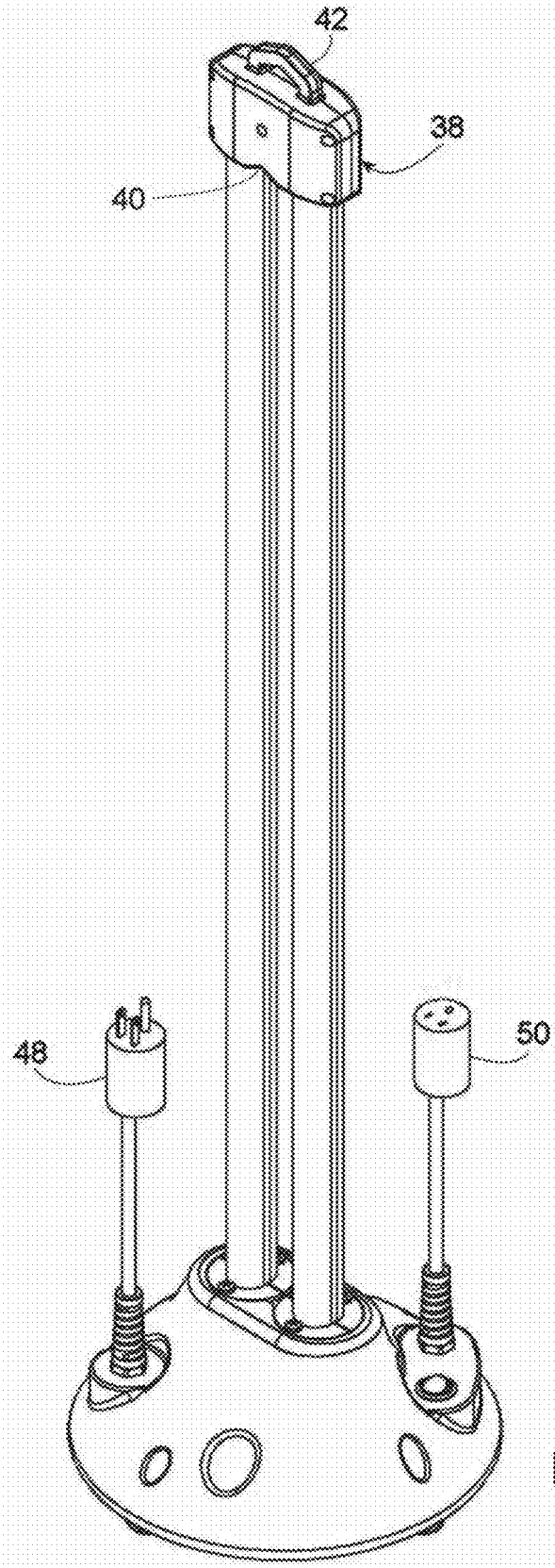
FIG. 11 illustrates a perspective view of the lighting apparatus of FIG. 1 without the coupling ties.

Turning again to FIG. 1, electric plug 48 and electric socket 50 may be provided on, or extend from, base 20. Preferably, electric plug 48 and electric socket 50 are of contractor grade and are provided at the ends of contractor-grade cables 58, which extend from base 20 and which may be surrounded by coils 60, either for a portion of their lengths, as shown in FIG. 9, or for their entire lengths.

In different embodiments, electric plug 48 and electric socket 50 may perform different functions. For example, electric socket 50 may be configured to receive a plug feeding electricity to lighting apparatus 18, or may be used to provide electricity to a plug inserted into socket 50. In one embodiment, there may be more than one socket 50, such that one socket may be used to receive electricity from a first plug and a second socket to provide electricity to a second plug.

In one application, a plurality of lighting apparatus 18 may be operatively connected in a "daisy chain" arrangement, by which cables connect different lighting apparatus 18 to each other and an intermediate lighting apparatus receives electricity from the preceding one and supplies electricity to the next one.

Figure 8:
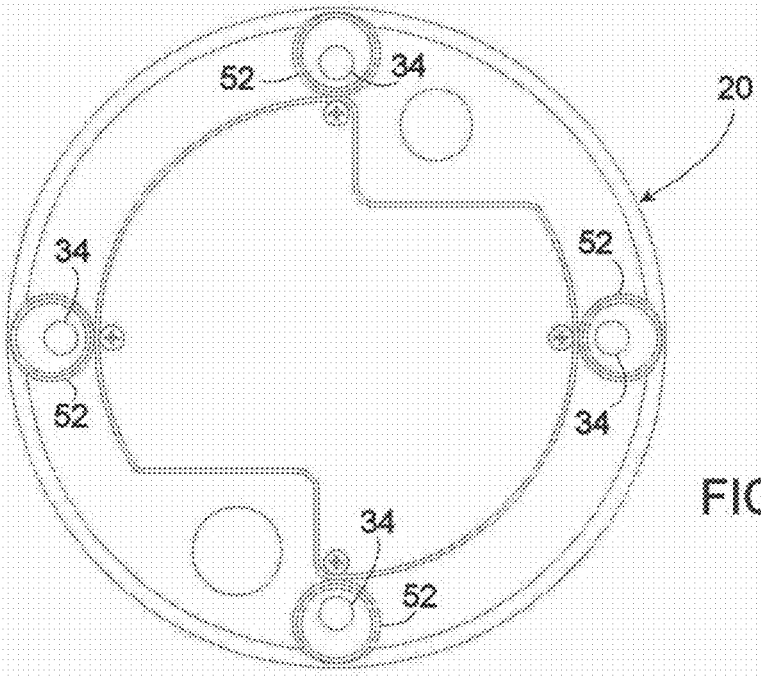
FIG. 8 illustrates a bottom view of the lighting apparatus of FIG. 1.

Lighting apparatus 18 may include various other elements that make its use even easier. For example, base 20 may include foot members 52 on its lower surface, as shown in FIG. 1 and more clearly in the bottom view depicted in FIG. 8. Small openings 34 may then be designed to cross base 20 and foot members 52, thereby improving the rotation of lighting apparatus 18 when affixed to a surface with a nail passing through opening 34. In that arrangement, foot members 52 space the bottom surface of base 20 from the underlying surface, decreasing friction.

Lighting apparatus 18 may also be provided with transparent covers 54 over lamps 22 and 24 to protect lamps 22 and 24 from damage, especially in construction sites. In one embodiment, covers 54 are made of a clear plastic material.

As mentioned, one of the possible uses of lighting apparatus 18 is to inspect the construction quality of a surface. The following description relates to the quality of construction or repair of a wall, but is equally applicable to ceiling or any other surfaces. For example, a construction operator may wish to check the quality of tape joints between sheetrock boards and of other patching repairs made to a wall.

The room, where the wall to be inspected is located, is preferably darkened in order to have the light projected by lighting apparatus 18 make any imperfections more evident. The construction operator then positions lighting apparatus 18 with the lower surface of base 20 on the wall to be inspected, and may affix base 20 to the wall by inserting a nail or screw through one of small openings 34 and into the wall.

Lighting apparatus 18 projects light in the direction opposite strips 32 of lamps 22 and 24, and projection of light is enhanced if strips 32 are made of a reflective material.

The light projected by lighting apparatus 18 hits the underlying wall near tangentially and, as shown in FIG. 12, causes imperfections 56 on the underlying wall to become apparent by becoming brightly illuminated and by projecting a shadow that highlights their presence. The construction operator can inspect larger portions of the wall by rotating base 20 about the nail coupled to base 20.

While the preceding description has made reference to applications in the construction industry, different experiments have shown that a lighting apparatus according to the invention is equally effective in detecting surface imperfections in other environments, for example, in car painting and wood staining applications. Moreover, due to the openings in its base, a lighting apparatus according to the invention finds beneficial uses as quick-installation lighting device that illuminates dark areas, because it can be easily affixed to a wall with a fastener and provide illumination into a dark area. When connected in a daisy-chain arrangement, a plurality of lighting apparatus 18 can be used to illuminate larger area such as garages, warehouses, or construction sides.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become apparent to those skilled in the art and the scope of the present invention is limited only by the appended claims.

What is claimed is:

1. A lighting apparatus comprising:

a base dimensioned to be portable by an adult and one or more lamps extending upwardly from the base, the one or more lamps each having a longitudinal portion preventing passage of light, wherein a plurality of openings are defined in the base, such to enable an operator to couple the base to a surface or to an end of a tube, wherein the plurality of openings are spaced around the one or more lamps, at least some of the openings being dimensioned to receive a fastener that affixes the base to a surface, and wherein at least one of the opening is dimensioned to receive the tube, the tube being a scaffolding tube.

2. The lighting apparatus according to claim 1, wherein the at least one of the openings dimensioned to receive the scaffolding tube comprises at least one opening having diameter of 27 mm (1 1/16 in) and at least one opening having a diameter of 33 mm (1 5/16 in).

3. The lighting apparatus according to claim 1, further comprising a plurality of foot members extending from a lower surface of the base, wherein at least one of the openings extends longitudinally through one of the foot members.

4. A lighting apparatus comprising:

a base dimensioned to be portable by an adult and one or more lamps extending upwardly from the base, the one or more lamps each having a longitudinal portion preventing passage of light, wherein a plurality of openings are defined in the base, such to enable an operator to couple the base to a surface or to an end of a tube, and wherein the lamps are tubular LED lamps.

5. The lighting apparatus according to claim 4, wherein the longitudinal portion preventing passage of light is a strip of an aluminum coating provided on each of the tubular LED lamps.

6. The lighting apparatus according to claim 4, wherein the longitudinal portion preventing passage of light is a strip is made from a reflective material.

7. The lighting apparatus according to claim 4, further comprising clear sleeves provided over each tubular LED lamp.

8. The lighting apparatus according to claim 4, wherein the plurality of openings are spaced around the one or more lamps, at least some of the openings being dimensioned to receive a fastener that affixes the base to a surface.

9. A lighting apparatus comprising:

a base dimensioned to be portable by an adult and one or more lamps extending upwardly from the base, the one or more lamps each having a longitudinal portion preventing passage of light, wherein a plurality of openings are defined in the base, such to enable an operator to couple the base to a surface or to an end of a tube, and wherein there are two lamps that are elongated in shape, and wherein upper ends of the two lamps are joined to one another by a bridge.

10. The lighting apparatus according to claim 9, wherein the bridge has a notch defined on a lower surface thereof to enable suspending the lighting apparatus from a protruding member, and further has an eyelet on an upper surface.

11. The lighting apparatus according to claim 10, further comprising one or more coupling ties coupled to the eyelet, the coupling ties enabling a coupling of the lighting apparatus to an outer member.

12. The lighting apparatus according to claim 11, wherein the one or more coupling ties are gear ties.

13. A lighting apparatus comprising:

a base dimensioned to be portable by an adult one or more lamps extending upwardly from the base, the one or more lamps each having a longitudinal portion preventing passage of light, wherein a plurality of openings are defined in the base, such to enable an operator to couple the base to a surface or to an end of a tube; and an electric plug and an electric socket provided in or extending from the base.

14. The lighting apparatus according to claim 13, wherein the electric plug and the electric socket extend upwardly from the base and are each coupled to the base by a cable surrounded by a coil.

15. The lighting apparatus according to claim 13, wherein one of the electric plug or the electric socket is configured to receive electric power and the other one of the electric plug or the electric socket is configured to provide the electric power.

* * * * *